US005471690A

United States Patent [19]

McNeil

[11] Patent Number: 5,471,690

[45] Date of Patent: Dec. 5, 1995

[54] TRAVEL PILLOW

[76] Inventor: Spencer E. McNeil, 27 Melrose St., No. 5, Boston, Mass. 02116

[21] Appl. No.: 312,455

[22] Filed: Sep. 26, 1994

[51] Int. Cl.[6] ..... A47C 16/00; A47G 9/00

[52] U.S. Cl. ..... 5/644; 5/926; 5/654; 297/397

[58] Field of Search ..... 5/926, 636, 644, 5/653–655; 297/393, 397

[56] References Cited

U.S. PATENT DOCUMENTS

| | | | |
|---|---|---|---|
| 305,428 | 9/1884 | Covert | 5/644 X |
| 673,872 | 5/1901 | Hillern-Flinsch | 5/636 X |
| 4,031,578 | 6/1977 | Sweeney et al. | 5/636 X |
| 4,236,264 | 12/1980 | Britzman | 5/644 X |
| 4,345,347 | 8/1982 | Kantor | 5/644 |
| 4,768,246 | 9/1988 | Summer | 5/636 X |
| 5,025,518 | 6/1991 | Summer | 5/636 |

*Primary Examiner*—Michael F. Trettel

*Attorney, Agent, or Firm*—Robert K. Tendler

[57] ABSTRACT

A travel pillow is provided in the form of a torus which is inflated and which has an integral bottom backing member adapted to coact with the seat back of a chair in a plane, train, bus, or automobile in which sleep is promoted regardless of movement of the individual's head during sleep periods because the pillow permits both rotation of the head within the torus during sleep and also movement of the pillow laterally and vertically as it slips against the seat back during natural sleep movements.

10 Claims, 5 Drawing Sheets

TRAVEL PILLOW

FIELD OF THE INVENTION

This invention relates to pillows utilized for travelers and more particularly to a toroidal shaped pillow which permits movement of the head of the individual during sleep without awakening the individual.

BACKGROUND OF THE INVENTION

It will be appreciated that a wide variety of pillows are utilized by travelers on trains, buses, airplanes, and cars to permit the individual to sleep while traveling. Prior travel pillows have tended to be flawed in terms of either being bulky or requiring permanent attachment to the seat; or fit around the neck of the individual like a collar to provide a stationary support for the head.

Neck engaging pillows such as illustrated by U.S. Pat. Nos. 5,129,705; 4,776,049; 4,738,488; 4,617,691; 4,345, 347; 4,285,081; 2,522,120; 2,336,707; 941,043; and 673, 372 and all have as their major thrust providing a stationary support for the head by providing a neck engaging yoke. It will be appreciated that the entire purpose of these devices is to provide a stationary support for the head and therefore prevent it from moving while at the same time supporting the individual's head so that the pillow does not slip off during sleep. In use these devices actually tend to immobilize the neck and the head which makes them uncomfortable and makes sleep difficult.

However, these types of devices are both uncomfortable and limit or do not allow the normal motion of the neck and head of a sleeping individual, in which the head moves from side to side or up and down as part of the natural sleep pattern. These devices are thus uncomfortable and awkward, often causing neck strain and resulting in the waking up of the individual as the head moves during the sleep pattern.

There is another class of devices for inducing or promoting sleep while traveling which are characterized by the clamping of the neck or head. Such devices are illustrated by U.S. Pat. Nos. 2,582,571; 2,856,366; 4,114,948; and 4,738, 488. It will be appreciated that all of these devices tend to wake up the individual when the head moves during the sleep cycle due to the restriction of the head and neck. Further, as illustrated in U.S. Pat. No. 5,205,611, this is a half clamp type structure in which the head can move in one direction but not in the other. Individuals utilizing this device may wake up either when the head moves into the stationary pillow or when the head moves in the opposite direction where there is no support. Finally, as illustrated in U.S. Pat. Nos. 4,042,278 and 4,440,443, rather than providing a tight fit around the neck or head, they engage the head loosely in the sense that the lateral supports are widely spaced apart. These devices thus do not promote sleep because they permit too much head movement and are therefore ineffective to maintain the sleep cycle.

There does exist a class of support pillows such as illustrated by U.S. Pat. Nos. 5,046,205; 5,025,518; 4,768, 246; and 3,848,281 which comprise apertured pillows that are adapted to fit the back of the head of an individual in which the head is positioned within the aperture. The problem with these types of devices is that when these apertured pillows are utilized as head supports, the back of the head of the individual contacts the seat back as the head projects through the aperture of the pillow. As a result, as the individual's head moves, the hair is grabbed by the seat back and the individual wakes up with the resulting tug on the hair. Another problem with such devices is that the hair of the individual may be messed up as the individual moves his head which is an annoyance factor.

The friction of the back of the individual's head contacting the seat back causes the individual to awaken for two reasons. First, the individual's head does not easily rotate within the aperture of the pillow. Secondly, the pillow does not readily move with respect to the seat back due to the frictional contact of the back of the head with the seat back itself.

In summary, the support devices described above are both cumbersome and tend to wake up the individual due to the inability of the support device to readily move against the seat back and due to the inability of the individual's head to move relative to the device. Also it should be noted that many of the above devices are utilized when the individual is in a supine or horizontal position and are not therefore readily suitable for seat back use.

SUMMARY OF THE INVENTION

In contradistinction to the above-type head pillows or support pillows, whether apertured or not, the Subject Invention is in the form of a smooth apertured pillow in which the pillow is backed with a smooth backing sheet. This provides a convenient, non-bulky, comfortable head support which is adapted to move relative to the seat back while at the same time permitting the head a friction-reducing surface over which to move within the aperture during the sleep cycle. In one embodiment, the Subject Invention is in the form of a torus with a smooth backing sheet in which the backing sheet slips easily over the seat back and forms a slippery surface over which the head can rotate within the torus.

The result of placing this torus at the back of the head as a halo is that uninterrupted sleep is obtained by the individual, with the projection of the head into the aperture of the torus maintaining the torus in place at the back of the head. The uninterrupted sleep comes from the fact that the individual's head slips within the torus due to the smooth backing sheet and the smooth sidewalls of the annulus to accommodate normal rotary motions of the head during sleep. This is because there is no significant frictional retarding force against the head as it rotates. Secondly, the entire structure is adapted to slip against the seat back such that lateral and vertical motions of the head are accommodated, again with minimal friction. Because the pillow permits a reduced friction support of the head vis-a-vis the seat back, the normal motions of the head during sleep are accommodated without awakening the individual.

Sleep is also promoted from the fact that the sides of the aperture, in conjunction with the portion of the device under the neck, prevent the head from falling off to the side which would eventually cause strain on the neck and wake the user.

In one embodiment the torus is an inflated device, with the inflation being adjustable to accommodate different head sizes and to provide adjustment of softness by the user. Alternatively, different size toroids can be provided depending on head size; or an inner bladder can be provided within an outer bladder to provide for adjustment of the toroid to head size.

It is a finding of this invention that regardless of the size of the torus vis-a-vis the individual's head, assuming a relative loose fit, the head is allowed to move during sleep and will not slip off from its position at the back of the head of the individual.

What will be appreciated is that this low friction device solves a unique problem for the traveler and that is the ability to sleep in a moving vehicle and remain unawakened during normal head motion either induced by sleep patterns or induced by the motion of the vehicle itself.

In summary, the smooth apertured and backed pillow is designed to allow the user to relax the neck muscles by supporting the head which enhances the user's ability to relax or sleep while traveling in a sitting position. This device also allows for lateral and vertical movement against the seat surface either while asleep or awake, thus reducing the likelihood of the device becoming dislodged or displaced. The smooth backing piece or covering is designed to allow the head to move without causing tangling of hair and reduces friction between the seat surface and the head by being interposed between the two. The backing also provides for the stability of the device by keeping it flat against the seat back when the head is angled, tilted, or moved while the head and pillow are resting against the seat surface.

As mentioned above, the torus can be provided in an inflatable embodiment which additionally allows for adjustment of the softness by the user and provides a degree of portability insofar as the device can be deflated and carried deflated prior to use. Alternatively, the toroid can be constructed of solid foam and can be of different shapes as long as the resulting structure permits rotation of the head within an aperture and sliding of the entire device across the seat back.

The toroidal or halo configuration allows the travel pillow to shift while the user is moving his or her head without the pillow losing its utility by becoming dislodged. By angling or tilting the head back while providing some lateral support, the subject device partially immobilizes the neck which prevents the head from angling down towards the shoulder but does not immobilize the neck.

With respect to the tilting of the neck back, the apertured pillow permits the easy tilting back of the head which opens the air passageways to make for comfortable breathing and often eliminates snoring.

In summary, the apertured pillow with its backing sheet allows for mobility of the neck, head, and shoulders and torso of the user while asleep. Generally such movement is necessary while sleeping in order to prevent various muscles of the neck, shoulders, and torso from stiffening up. This natural motion of the head during sleep is in part why stiffening does not occur naturally but only when the head is supported by a substantially stationary device. It will be appreciated that the user of the subject device can change position while the pillow stays in place as long as the head is not lifted substantially off the plain of the seat back. Note that it has been found that the subject pillow will not dislodge when the head naturally lifts an inch or two off the back of the seat.

BRIEF DESCRIPTION OF THE DRAWINGS

These and other features of the Subject Invention will be better understood taken in conjunction with the Detailed Description in conjunction with the Drawings of which.

DETAILED DESCRIPTION

Figure 1:
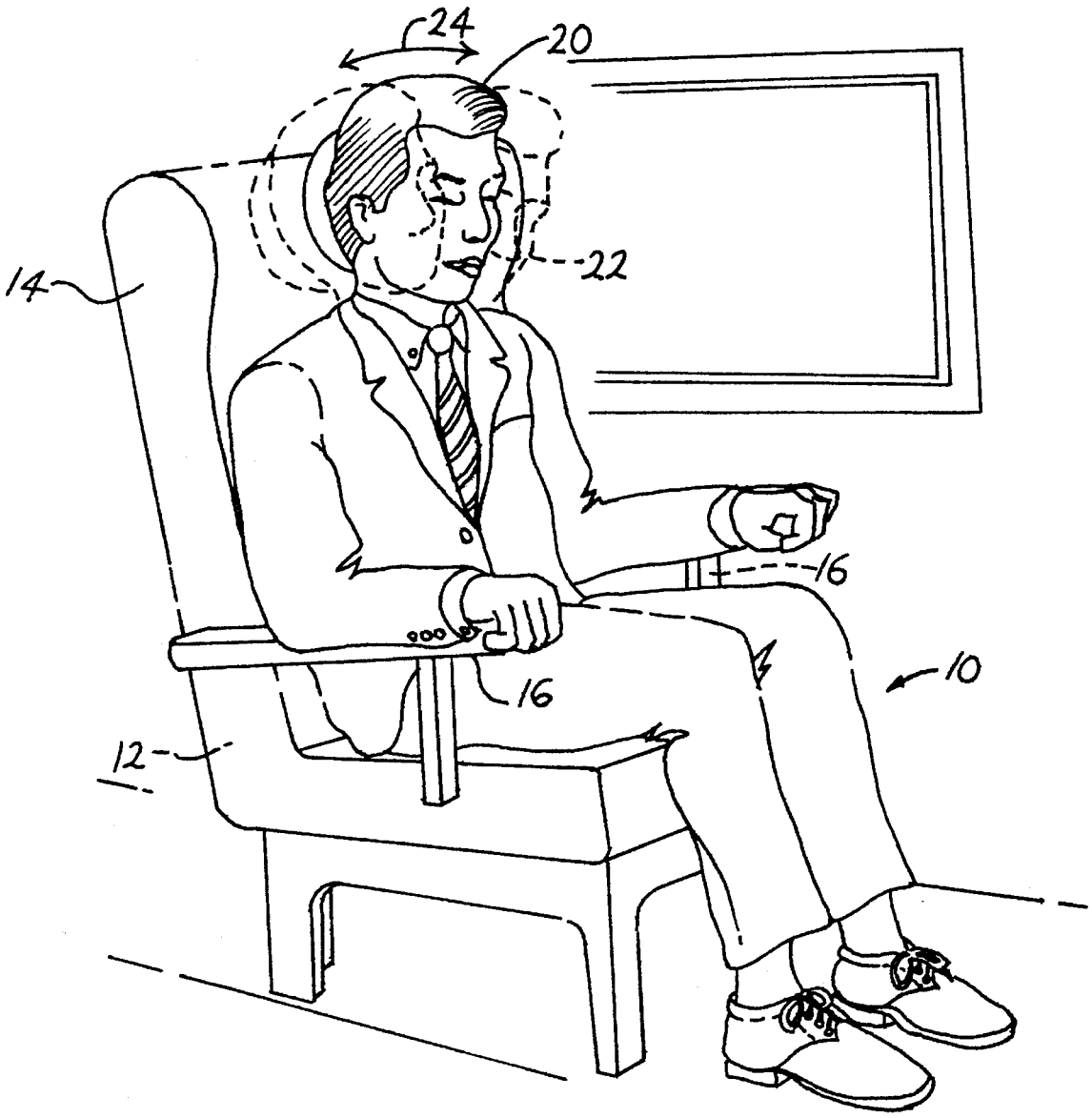
FIG. 1 is a diagrammatic illustration of the subject travel pillow illustrating the movement of an individual's head across the seat back as the individual is sleeping while sitting.

Referring now to FIG. 1, an individual 10 is illustrated seated in a chair 12 having a seat back 14 and arms 16. The individual's head is illustrated at 20 which moves as illustrated by dotted outline 22 during normal sleep patterns as illustrated by arrow 24. Of course the individual can also slide up and down in the chair during sleep periods. It will be appreciated that during sleep the individual's head does not remain stationary, but moves relative to the seat back laterally and vertically. If the head is unsupported, the hair of the individual becomes entangled in the seat back which causes the individual to wake up under normal circumstances. Additionally, the seat back does not in and of itself provide any lateral head support such that as the individual nods off, the head goes to the side and falls forward which wakes the individual. Moreover, the individual is awakened by the stress of the neck muscles as the head moves. It is for this reason that pillows have been provided. As mentioned hereinabove, it was thought that by completely immobilizing the head, the pillow would not drop away from the individual, while still providing head support. More importantly, it was thought by providing a stationary support for the head, not only would the pillows stay in place, but also appropriate sleep would be induced.

Figure 2:
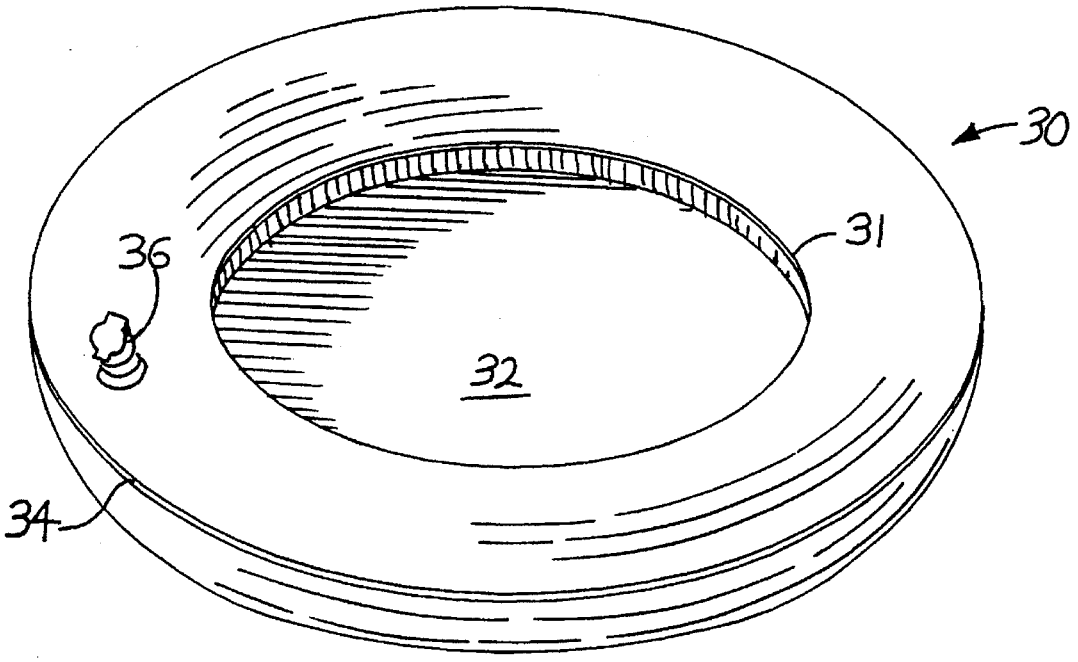
FIG. 2 is a top view of the subject travel pillow illustrating an inflatable torus along with a smooth backing sheet.

It is the finding of this invention that providing a stationary support for the head is to be avoided in order to induce sleep or to maintain a sleep pattern once it has been induced. It is a further finding of this invention, and as illustrated in FIG. 2, that through the utilization of the toroidally shaped and backed pillow 30 having an aperture 31 and a smooth backing sheet 32, the head can easily slip across the back of the chair illustrated in FIG. 1 without awakening the individual. The reason for this is that the pillow of FIG. 2, having a smooth backing sheet, slips across the seat back as will be described in connection with FIGS. 4 and 5.

It is also important that the individual's head be able to rotate within the pillow aperture, and it is for this reason that the apertured pillow of FIG. 2 is provided with smooth aperture side walls and with the smooth backing sheet or diaphragm 32 which, in one embodiment, is integrally attached as illustrated at 34. In one embodiment, the pillow is in the form of a torus and is inflated in one embodiment through the utilization of a valve 36 which is sealable after inflation.

Figure 3:
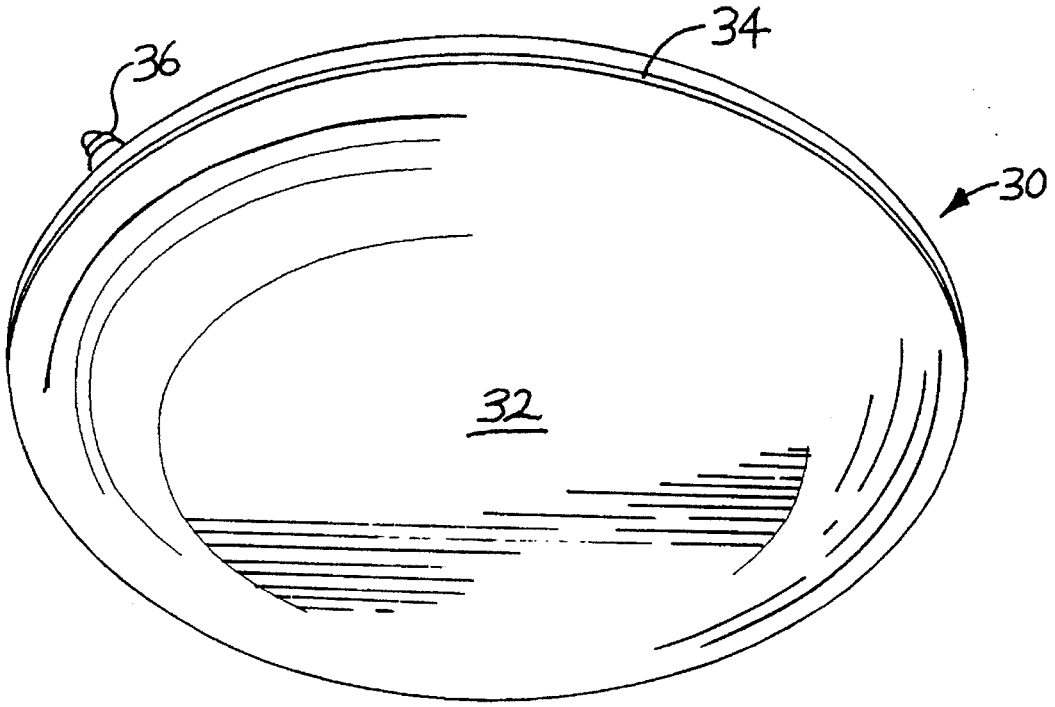
FIG. 3 is a bottom view of the travel pillow of FIG. 2 illustrating the positioning of the backing sheet across the entire back surface of the pillow.

Referring to FIG. 3, the toroidally shaped pillow of FIG. 2 is illustrated in which it can be seen that backing sheet 32 extends across the entire bottom of the torus and is adapted to coact with the seat back to provide for a low friction engagement between the two.

Figure 4:
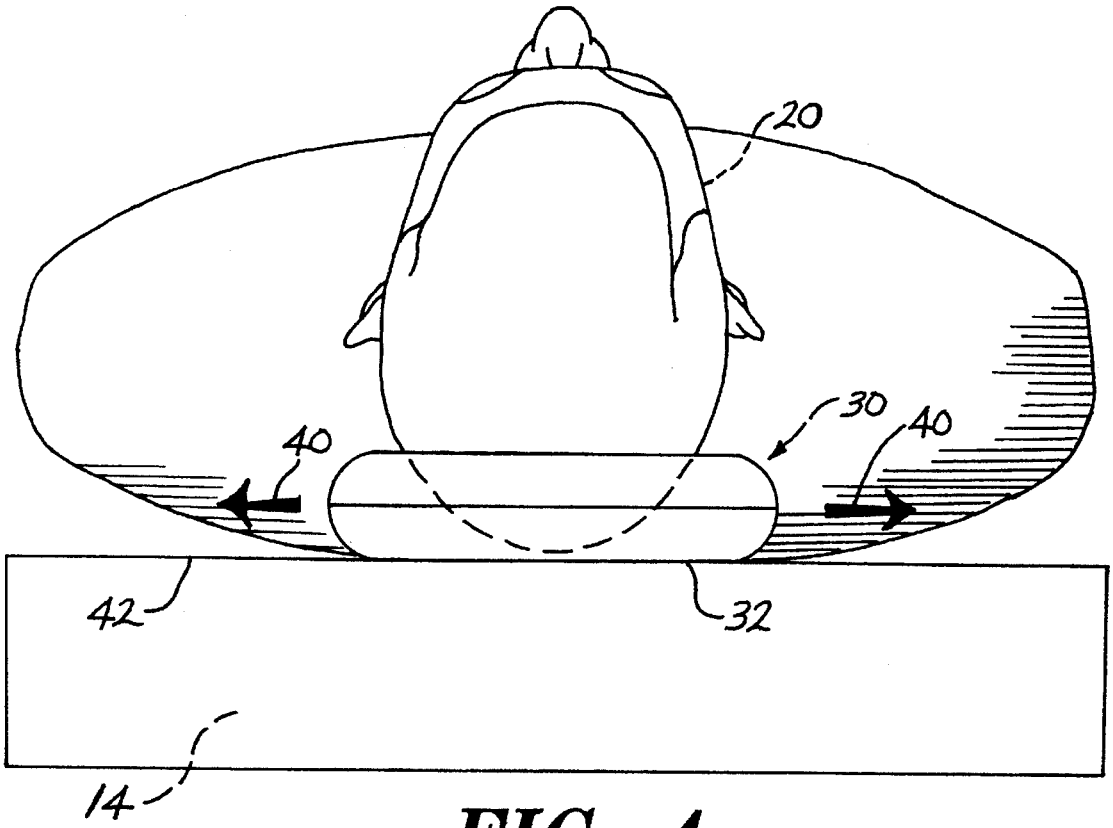
FIG. 4 is a top view of an individual utilizing the subject pillow, illustrating the ability of the pillow to slip laterally over a seat back.

Referring now to FIG. 4, it can be seen that the toroidally shaped pillow is permitted to move laterally in the direction illustrated by arrows 40 because the smooth backing sheet engages the surface 42 of seat back 14 to provide low friction engagement. It will be appreciated that while in use, the pillow may also move vertically with equal ease. The result is that lateral and vertical motion is permitted due to the reduced friction.

Figure 5:
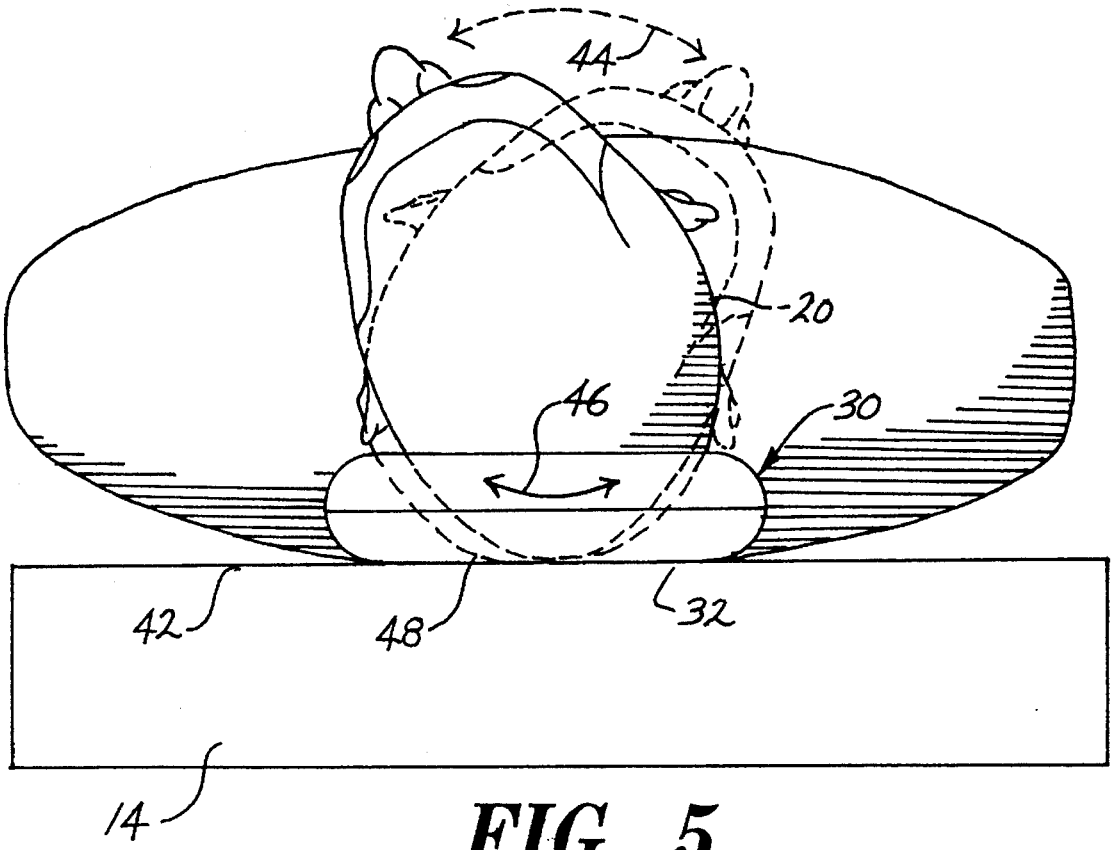
FIG. 5 is a top view of an individual using the subject pillow, illustrating the ability of the individual to easily rotate his head within the aperture of the subject travel pillow during sleep patterns.

Referring now to FIG. 5, rotation of head 20 illustrated by arrows 44 and 46 is accommodated within the aperture of the toroid such that the back portion of the head 48 is permitted to rotate against the smooth inner surface of backing 32. It will also be appreciated that the sides of the head contact the smooth inner surfaces of the toroid in a low friction engagement such that the head can easily move in the directions shown during the normal sleep process.

Figure 6:
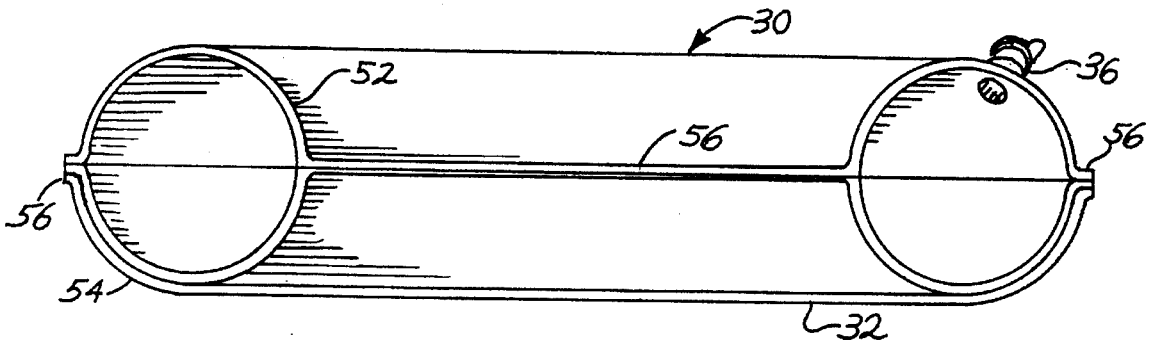
FIG. 6 is a cross sectional view of the pillow of FIG. 2 illustrating the integral backing sheet and the attachment thereto.

In order to provide the low friction environment and as illustrated in FIG. 6, toroid 30 may be formed by two elastomeric disks, in one embodiment a polyvinyl or rubber material as illustrated at 52 and 54, with the disks being sealed together along a welded seam 56. When these two disks are so joined and air is introduced at valve 36, the toroid takes the shape shown. Alternatively the shape can be oval or even rectilinear.

As can also be seen, backing 32 is joined at the side of the torus through the welding of this backing at seam 56 such that the backing stretches across the bottom of the inflated torus.

It will be appreciated that the materials utilized are adapted to have surfaces that permit the slippage of the device across the seat back, whatever the material of the seat back may be, and also slippage of the head within the aperture of the pillow.

Figure 7:
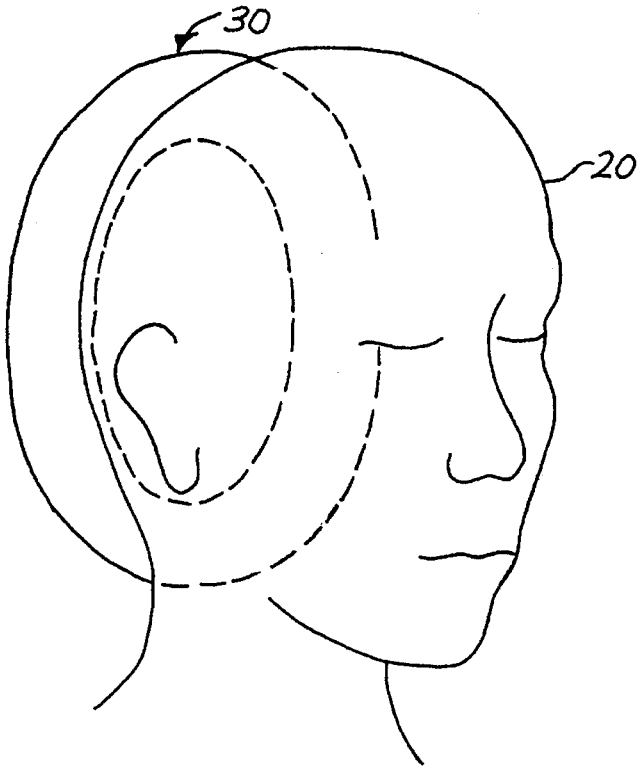
FIG. 7 is a diagrammatic illustration of the pillow of FIG. 2 in place as a halo at the back of the head of an individual.

Referring now to FIG. 7, it will be seen that toroidally shaped pillow 30 is adapted to be positioned at the back of individual 20's head when in use. It is the positioning of the pillow in the manner of a halo which provides lateral support to the head of the individual during sleep, with the pillow providing the usual comfort features of a pillow in terms of non-restricting support.

Figure 8:
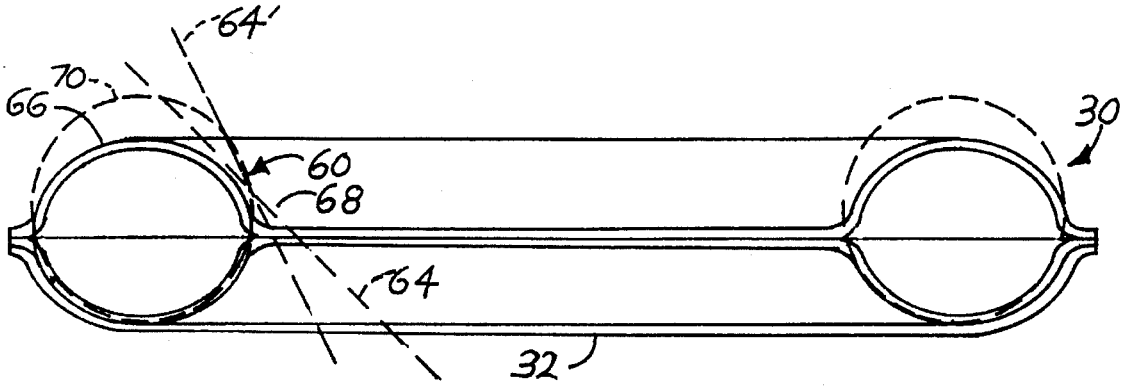
FIG. 8 is a diagrammatic representation of the oval shaped cross section of the pillow of FIG. 6 which is produced with flat disks of elastomeric material when the pillow is inflated.

Referring now to FIG. 8, it has been found that torus 30 when formed with identically apertured disks and a backing sheet of equal diameter, produces a torus having a cross section which, instead of being circular, is oval as illustrated at 60, when the torus is inflated. In certain circumstances it has been found that an oval slope of the torus is insufficient to provide adequate lateral support for the back of the head because the slope at a tangent 64 to the surface 66 of the torus at a point 68 is too shallow. Were the cross-section to be circular as illustrated at dotted line 70, then slope 64' would be steeper and thus give greater lateral support.

Figure 9:
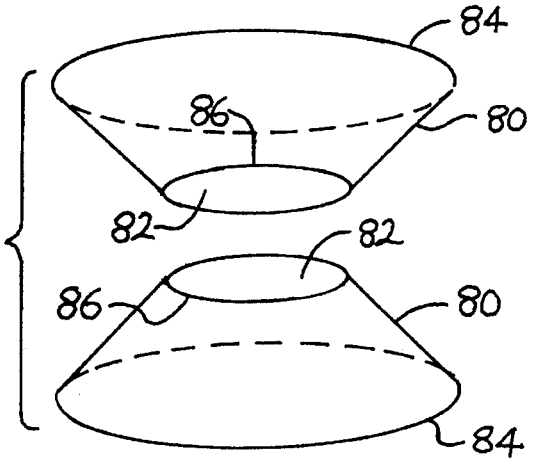
FIG. 9 is an exploded view of frustoconical shaped disks for use in place of the flat disks used to manufacture the pillow of FIG. 6; and, FIG. 10 is a diagrammatic representation of a pillow manufactured utilizing frustoconical disks in which the resulting inflated torus has a circular, as opposed to oval, cross section to provide for a more steep tangent line and thus increased lateral support for the head of an individual.
Figure 10:
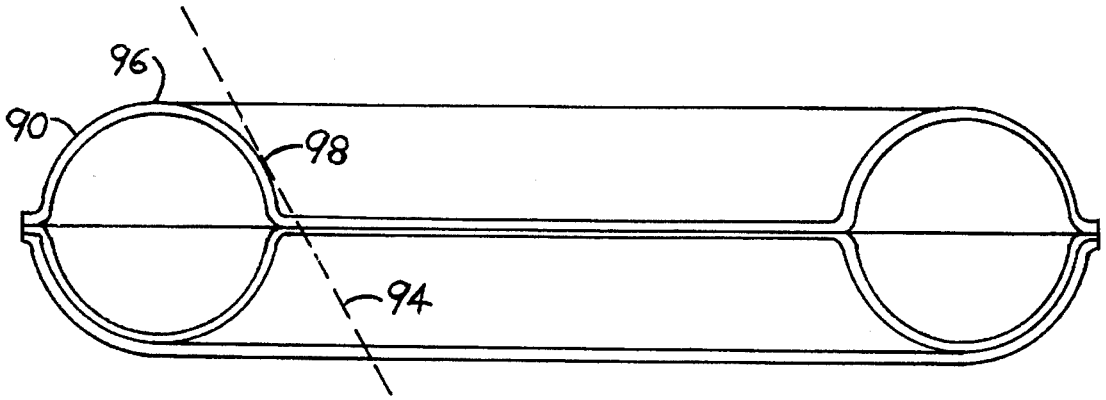

Referring now to FIG. 9, if the two disks utilized to form the torus of FIG. 6 were to be frustoconical in nature as illustrated by shape 80 and are centrally apertured as illustrated at 82, then assuming the joining of these frustoconical disks at their peripheries 84 and the inner edges 86 of the annuli, then as shown in FIG. 10 the final cross section 90 of the torus 30 is more circular such that a tangent 94 to surface 96 of the torus at point 98 is sufficiently steep to provide greater lateral support for the head of the user.

In summary by utilizing frustoconically shaped disks or sheets, the cross section of the torus when inflated can be made more circular.

Having above indicated a preferred embodiment of the present invention, it will occur to those skilled in the art that modifications and alternatives can be practiced within the spirit of the invention. It is accordingly intended to define the scope of the invention only as indicated in the following claims.

I claim:

1. Apparatus for promoting sleep while sitting in a seat having a seat back, said device adapted to be used at the back of the head of an individual between the head of said individual and said seat back for accommodating for the natural movement of the head of an individual during normal sleep patterns, comprising:

a seat having a seat back; and, a pillow having an aperture therethrough and a smooth slippery backing for said pillow coacting with said seat back and attached to said pillow at the back thereof, said backing covering said aperture and providing a slippery and smooth surface to permit the sliding of said pillow over said seat back and to permit the movement of the head of said individual within said aperture during said normal sleep patterns.

2. The apparatus of claim 1, wherein said pillow is in the form of a torus.

3. The apparatus of claim 2, wherein said torus is inflatable.

4. The apparatus of claim 2, wherein said pillow and backing is made of an elastomeric material.

5. The apparatus of claim 4, wherein said elastomeric material is selected from the group consisting of polyvinyl and rubber.

6. The apparatus of claim 2, wherein said torus includes two disks of elastomeric material each having a central aperture therethrough, means for sealing the periphery of said two disks together and means for sealing the annuli of said two disks together.

7. The apparatus of claim 6 wherein said disks before assembly are centrally apertured and frustoconical in shape.

8. The apparatus of claim 1, wherein said backing extends across the entire bottom of said pillow.

9. A travel device for promoting sleep while sitting in a seat having a seat back, said device adapted to be used at the back of the head of an individual between the head of said individual and said seat back for accommodating the natural movement of the head of an individual during normal sleep patterns, comprising:

a pillow having an aperture therethrough and a smooth backing for said pillow attached to said pillow at the back thereof, said backing covering said aperture and providing a smooth surface to permit the sliding of said pillow over said seat back and to permit the movement of the head of said individual within said aperture during said normal sleep patterns, said pillow being in the form of a torus, said torus including two disks of elastomeric material each having a central aperture therethrough, means for sealing the periphery of said two disks together and means for sealing the annuli of said two disks together.

10. The apparatus of claim 9, wherein said torus includes two disks of elastomeric material each having a central aperture therethrough, means for sealing the periphery of said two disks together and means for sealing the annuli of said two disks together, and wherein said backing extends across the entire back of said pillow, said pillow further including means for sealing said backing to said periphery.

* * * * *